US012173988B2

(12) United States Patent
Rudolph et al.

(10) Patent No.: US 12,173,988 B2
(45) Date of Patent: Dec. 24, 2024

(54) EXTENDED RANGE MULTI-CALIBER IN-BORE LASER BORESIGHT SYSTEM

(71) Applicant: The United States of America, as represented by the Secretary of the Navy, Crane, IN (US)

(72) Inventors: Brandon W Rudolph, Bloomington, IN (US); Matthew A Thompson, Bloomington, IN (US); Daniel S Spoor, Bloomington, IN (US)

(73) Assignee: The United States of America, Represented by the Secretary of the Navy, Washington, DC (US)

( * ) Notice: Subject to any disclaimer, the term of this patent is extended or adjusted under 35 U.S.C. 154(b) by 70 days.

(21) Appl. No.: 18/131,225

(22) Filed: Apr. 5, 2023

(65) Prior Publication Data

US 2023/0324142 A1 Oct. 12, 2023

Related U.S. Application Data

(60) Provisional application No. 63/328,406, filed on Apr. 7, 2022.

(51) Int. Cl.
*F41G 1/54* (2006.01)
*F42B 5/02* (2006.01)

(52) U.S. Cl.
CPC ..... *F41G 1/545* (2013.01); *F42B 5/025* (2013.01)

(58) Field of Classification Search
CPC ..... F41G 1/545; F41G 33/02
See application file for complete search history.

(56) References Cited

U.S. PATENT DOCUMENTS 5,001,836 A * 3/1991 Cameron ..... F41G 1/54 42/116
5,241,458 A * 8/1993 Abbas ..... F41A 31/02 362/186
5,365,669 A * 11/1994 Rustick ..... F41A 33/02 42/134
5,454,168 A * 10/1995 Langner ..... F41G 3/323 42/134
5,488,795 A * 2/1996 Sweat ..... F41A 33/02 362/112
5,685,106 A * 11/1997 Shoham ..... F41G 1/35 42/116
5,787,631 A * 8/1998 Kendall ..... F41A 33/02 42/116
6,061,918 A * 5/2000 Schnell ..... F41G 3/323 42/121

(Continued)

*Primary Examiner* — Jonathan C Weber
(74) *Attorney, Agent, or Firm* — Naval Surface Warfare Center, Crane Division; Christopher Feigenbutz

(57) ABSTRACT

Disclosed is an extended range multi-caliber in-bore laser boresight system for sighting in a firearm. The device includes one or more hollow cartridge cases that resemble a standard firearm case lacking a bullet, a laser module, and an external electronic package. The laser module fits within the hollow cartridge case and is positioned within a firearm chamber. The laser exits the hollow cartridge through the firearm barrel to aid with zeroing a firearm sighting system. The laser diode is powerful enough to be visible at extended ranges in bright sunlight. The inventive boresight system can be used for zeroing any desired caliber, such as from 5.56 NATO to .50 BMG at extended range.

18 Claims, 6 Drawing Sheets

(56) References Cited

U.S. PATENT DOCUMENTS

| | | | | |
|---|---|---|---|---|
| 6,237,236 | B1 * | 5/2001 | Schnell | F41G 1/545 33/334 |
| 6,631,580 | B2 * | 10/2003 | Lafrate | F41A 33/02 42/134 |
| 7,905,043 | B2 * | 3/2011 | Hopkins | F42B 5/02 42/114 |
| 10,317,172 | B1 * | 6/2019 | Morgan | F41G 1/545 |
| 2021/0270571 | A1 * | 9/2021 | Oliver | F41G 1/35 |

* cited by examiner

EXTENDED RANGE MULTI-CALIBER IN-BORE LASER BORESIGHT SYSTEM

CROSS-REFERENCE TO RELATED APPLICATIONS

The present application claims priority to U.S. Provisional Patent Application Ser. No. 63/328,406, filed Apr. 7, 2022, entitled "MULTI-CALIBER IN-BORE LASER BORESIGHT KIT," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 210906) is assigned to the United States Government and is available for licensing for commercial purposes. Licensing and technical inquiries may be directed to the Technology Transfer Office, Naval Surface Warfare Center Crane, email: Crane_T2@navy.mil.

FIELD OF THE INVENTION

The field of invention relates generally to firearms. More particularly, it pertains to an extended range multi-caliber in-bore laser boresight system for sighting in a firearm.

BACKGROUND

Small arms bore sighting, or zeroing, is a necessary process for ensuring accuracy of a firearm. Zeroing is the process of adjusting the sights of a firearm so that the fired round will land at a predictable and consistent position relative to the sights. A common method of zeroing is through the use of laser boresights, which are laser pointers that are mounted to the firearm and used to adjust the zero point of the firearm. Laser boresight systems reduce the amount of live fire needed to properly zero firearms as they provide a visible point to begin the zeroing process before any rounds are fired. Without going through this process, one could be entering scenarios with inaccurate weapons, drastically increasing the risk posed to the shooter.

Military personnel often find themselves in situations where they do not have time or access to a range for zeroing their weapon, such as when riding in a caravan or being stationed on a ship. Additionally, law enforcement, military, hunters, and recreational shooters use an extensive variety of rifle calibers, which causes bore sighting to become tedious and expensive since a different system is usually required for each caliber. The current process requires the user to fire their weapon, adjust their sight, and repeat until their sights are zeroed. This is complicated further if they have multiple weapons to zero. Because of the hassle and time involved, shooters often go without zeroing their weapon at all, and thus may be entering situations without properly sighted weapons. It is desirable to make bore-sighting a weapon less labor intensive for the user. Providing a method to zero any of their weapons, regardless of caliber and a greatly reduced amount of live fire, would address a significant shortcoming. Fewer resources would be necessary, and users would be better prepared for any potential shooting scenarios. As can be seen from the above, it is evident that a solution for zeroing a variety of rifle calibers is needed.

SUMMARY OF THE INVENTION

The present invention relates to an extended range multi-caliber in-bore laser boresight system for sighting in a firearm. The device includes one or more hollow cartridge cases that resemble a standard firearm case lacking a bullet, a laser module, and an external electronic package. The laser module fits within the hollow cartridge case and is positioned within a firearm chamber. The laser exits the hollow cartridge through the firearm barrel to aid with zeroing a firearm sighting system. The laser diode is powerful enough to be visible at extended ranges in bright sunlight. The inventive boresight system can be used for zeroing any desired caliber, such as from 5.56 NATO to .50 BMG at extended range.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, provided is an extended range multi-caliber laser boresight system for sighting in a firearm comprising: a hollow cartridge case comprising an elongated body, an aperture in place of a bullet, an open end, an ejector rim, and a cutout in said body and in said ejector rim; a laser module comprising a laser diode, focusing optics, and a protrusion; and an external electronic package comprising a power supply, one or more switches, and circuitry for said laser module; wherein said laser module fits through said open end and is secured within said hollow cartridge case by mating said cutout with said protrusion; wherein said laser module is electrically connected to said external electronic package through one or more wires; and wherein said laser diode produces a visible laser that exits said hollow cartridge case through said aperture for sighting in said firearm.

In an illustrative embodiment, the hollow cartridge case is sized and shaped to fit within a firearm chamber ranging from 5.56 NATO to .50 BMG. In an illustrative embodiment, the system comprises more than one of said hollow cartridge cases, wherein each of said more than one hollow cartridge cases fits within a different firearm chamber ranging from 5.56 NATO to .50 BMG. In an illustrative embodiment, the hollow cartridge case is manufactured to the Sporting Arms and Ammunition Manufacturers' Institute American National Standards. In an illustrative embodiment, the external electronic package comprises a master on/off power switch for said laser diode, a momentary switch for said laser diode to detect if said boresight is in a bore of said firearm, and a high/low output power switch for said laser diode. In an illustrative embodiment, the hollow cartridge case is sized and shaped to fit within a 5.56 NATO firearm chamber and wherein said laser diode has a maximum diameter of 9.5 mm. In an illustrative embodiment, the laser diode that operates in the range of 5 mW-60 mW. In an illustrative embodiment, the laser diode comprises a PL520 diode that operates at 50 mW and is visible at distances of greater than 100 yards in sunlit conditions.

In an illustrative embodiment, provided is an extended range multi-caliber laser boresight system for sighting in a firearm comprising: a hollow cartridge case; a laser module; and an external electronic package comprising a power supply, one or more switches, and circuitry for said laser module; wherein said laser module secures within said hollow cartridge case; and wherein said laser diode produces a visible laser that exits said hollow cartridge case through said aperture for sighting in said firearm.

Figure 1:
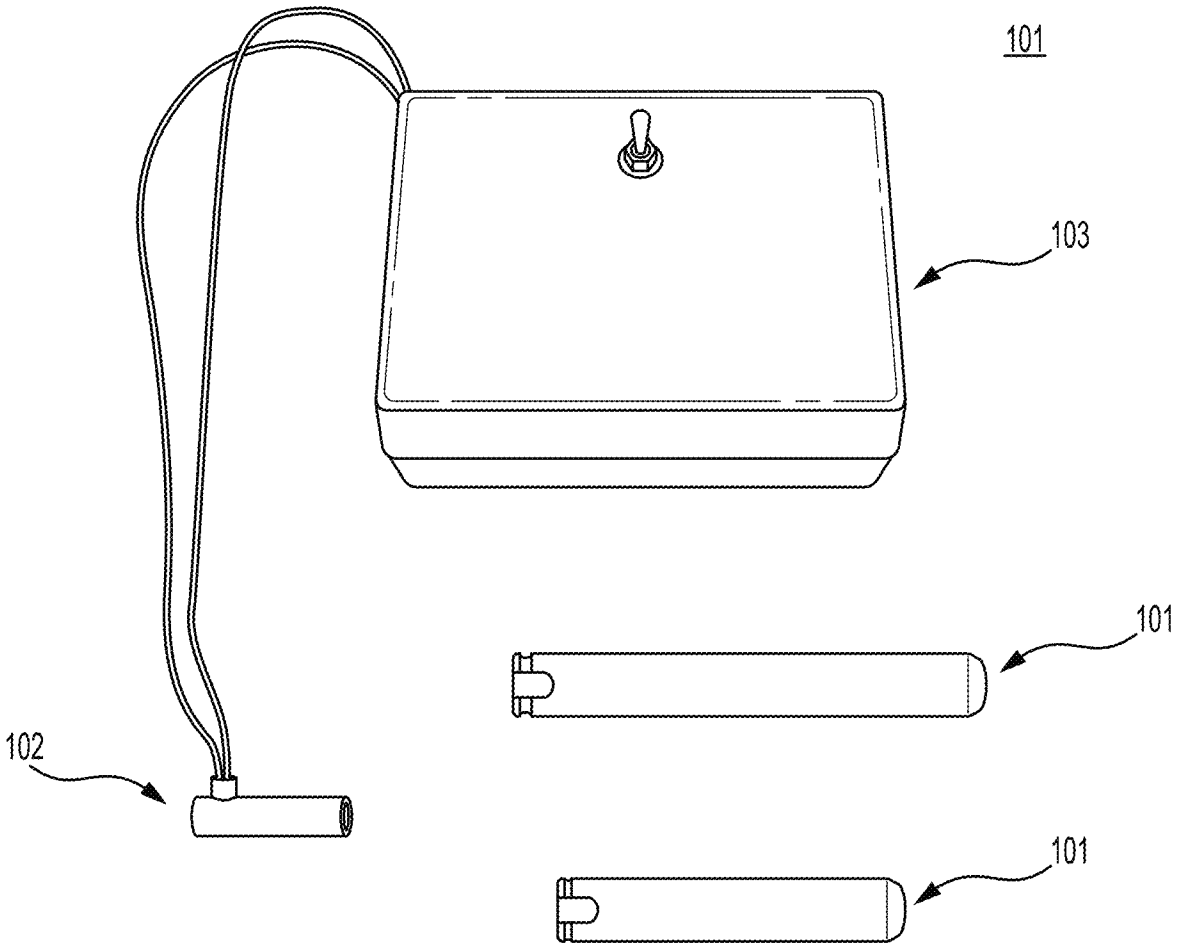
FIG. 1 shows a view of a pair of hollow cartridge cases, a laser module, and an external electronic package.
Figure 2:
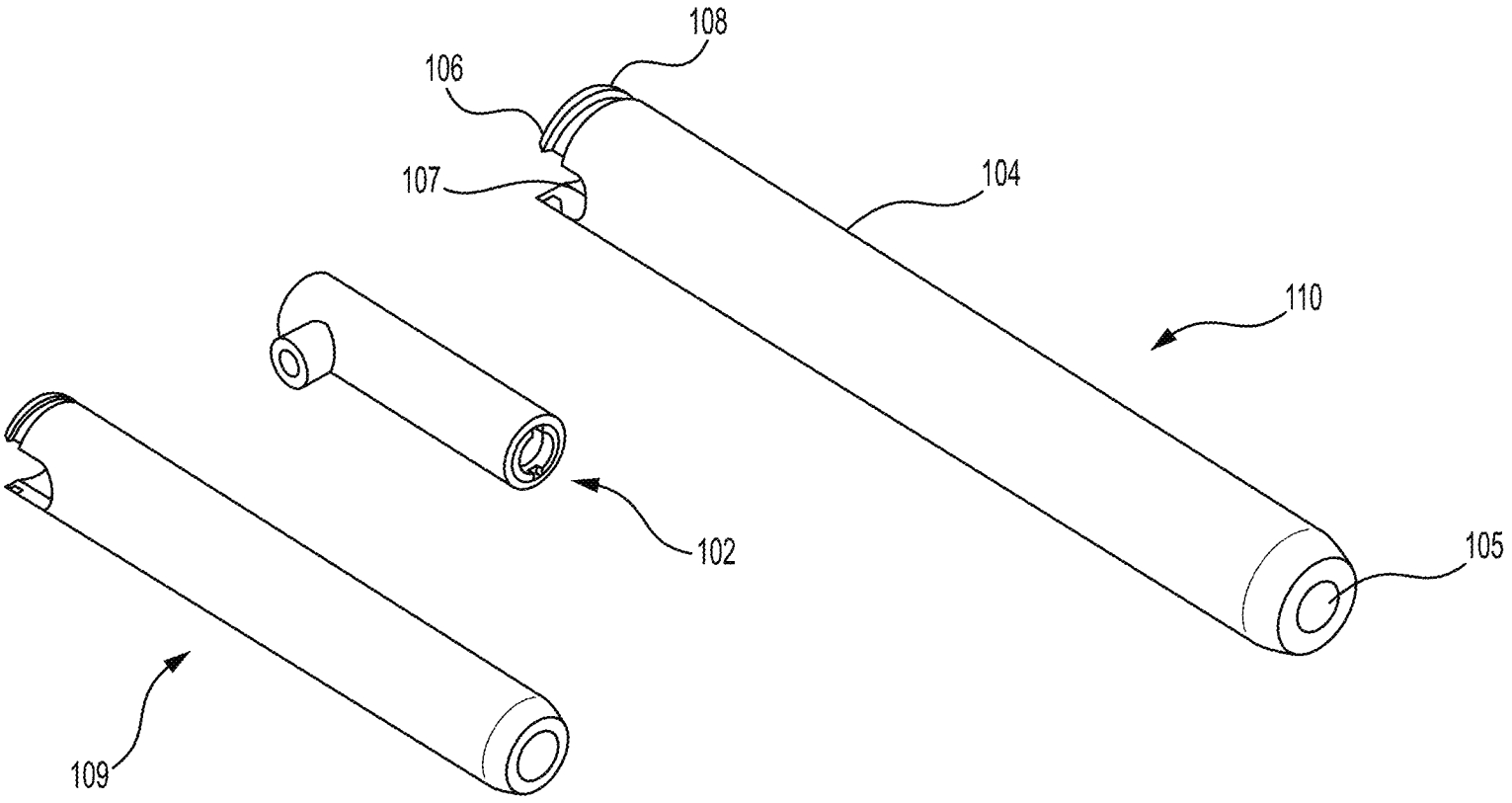
FIG. 2 shows a perspective view of a laser module and hollow cartridge cases.

FIG. 1 shows a view of a pair of hollow cartridge cases 101, a laser module 102, and an external electronic package 103, and FIG. 2 shows a perspective view of a laser module 102 and of a pair of hollow cartridge cases 101. In an illustrative embodiment, the hollow cartridge case 101 resembles a standard firearm case lacking a bullet. The case 101 includes an elongated body 104, an aperture 105 in place of a bullet, an open end 106, an ejector rim 107, and a cutout 108 in the body 104 and in the ejector rim 107. In an illustrative embodiment, the system includes one or more hollow cartridge cases. In an illustrative embodiment, the system included several hollow cartridge cases ranging from 5.56 NATO to .50 BMG, a single laser module, and an external electronic package. In an illustrative embodiment, the cartridge case 101 is sized and shaped to fit within a firearm chamber ranging from 5.56 NATO to .50 BMG. As a non-limiting illustrative example, shown is a first case 109 sized to fit within a 5.56 NATO firearm chamber and a second case 110 sized to fit within a .300 Win Mag firearm chamber.

In the preferred embodiment, all parent cases are manufactured to the Sporting Arms and Ammunition Manufacturers' Institute ("SAAMI") American National Standards. As is well known, SAAMI is an accredited standards developer that publishes several American National Standards that provide safety, reliability, and interchangeability standards for commercial manufacturers of firearms, ammunition, and components. In place of a standard bullet, the bullet end of the hollow cartridge cases 101 includes an aperture 105. The aperture 105 permits the laser to exit the hollow cartridge cases 101 and to travel though the barrel of the firearm that the boresight is being used with, which will be shown in greater detail below.

Figure 3:
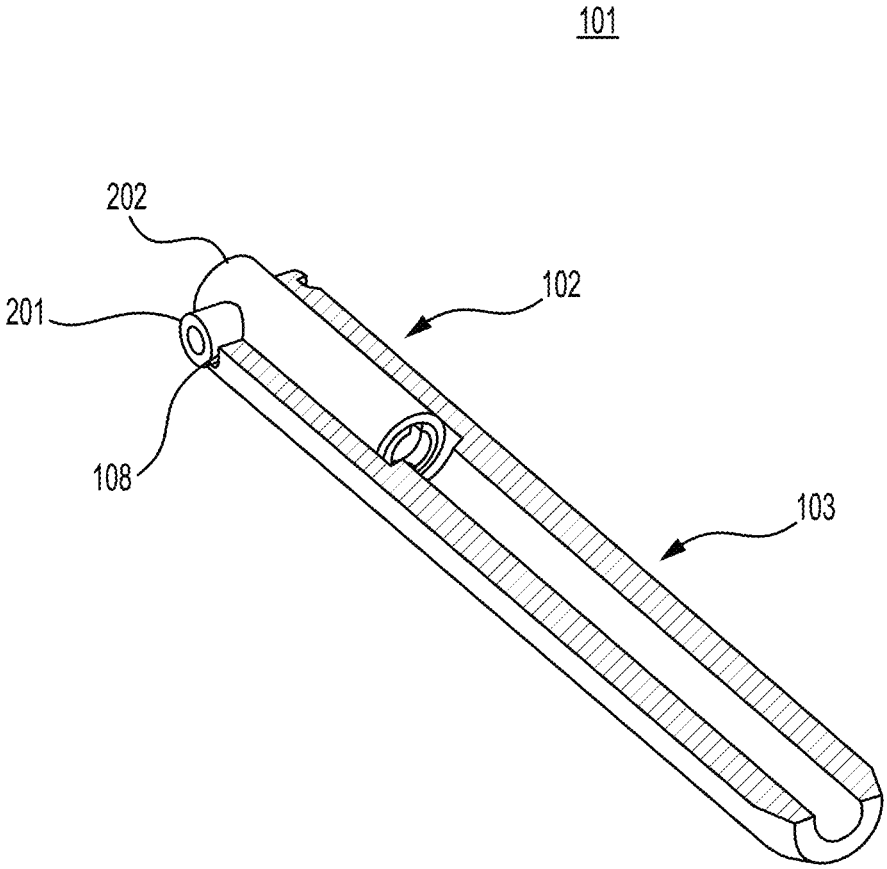
FIG. 3 shows a view of a laser module inserted into a hollow cartridge case.

FIG. 3 shows a view of a laser module 102 inserted into a hollow cartridge case 101. In an illustrative embodiment, the laser module 102 includes a protrusion 201 extending from the base 202 that mates with the cutout 108 in the hollow cartridge case 101. The mating secures the laser module 102 within the hollow cartridge case 101. Regardless of hollow cartridge case 101 size, each hollow cartridge case 101 includes a cutout 108 for insertion and securing of the laser module 102. In an illustrative embodiment, more than one cutout can be included to improve ease of installation and removal of the laser module 102 inside the hollow cartridge case 101 and to aid in removing the device from the firearm.

Figure 4:
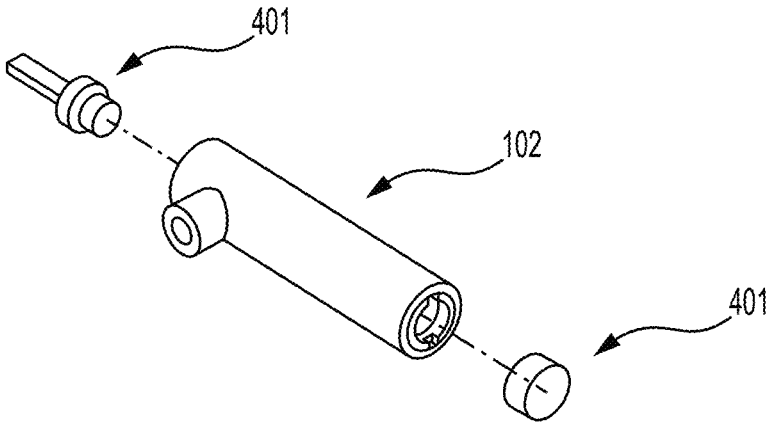
FIG. 4 shows an exploded view of a laser module.

FIG. 4 shows an exploded view of a laser module 102. The laser module 102 contains focusing optics 401 and a laser diode 402, which are sized to fit within the smallest hollow cartridge case. As can be appreciated, light source selection is a primary consideration of the inventive boresight since the laser diode 402 must fit within the laser module 102 and still provide sufficient power output to be visible at extended ranges. In an illustrative embodiment, 5.56 NATO is the smallest caliber selected for use as a hollow cartridge case 101 and therefore provides the maximum allowable diameter of the laser diode. In an alternate embodiment, smaller calibers, such as .22 Long Rifle or .17 Hornady Magnum Rimfire are contemplated for use with the inventive boresight. When basing the laser module 102 on a 5.56 NATO firearm chamber, the laser module 102 has to fit both the focusing optics 401 and the laser diode 402 while still fitting within a 5.56 NATO hollow cartridge case 101. In this non-limiting embodiment, the maximum available diameter of laser diode 401 is 9.5 mm. As can be appreciated, a larger diameter diode would result in thinner wall thicknesses for the laser module 102 and hollow cartridge cases, which reduces structural stability.

In an illustrative embodiment, the laser is visible at extended ranges. In one embodiment, extended range is defined as 100 yards or more. In order for the laser to be visible at 100 yards or more, a higher laser output is necessary as compared to conventional boresight devices that are known and used in the art. As can be appreciated, conventional laser boresights operate at ≤5 mW and are only reliably visible at ≤25 yards. To overcome this inherent limitation, diodes with radiant power ranges of 5 mW-60 mW are contemplated.

In one illustrative embodiment, the inventive boresight utilizes a PL520 diode that operates at 50 mW. The PL520 diode has a diameter of 3.8 mm, allowing it to fit inside the laser module without compromising the integrity of either the module 102 or the hollow cartridge case. The 50 mW radiant power enables the boresight to be visible at 100+ yards, even in bright sunlight.

Figure 5:
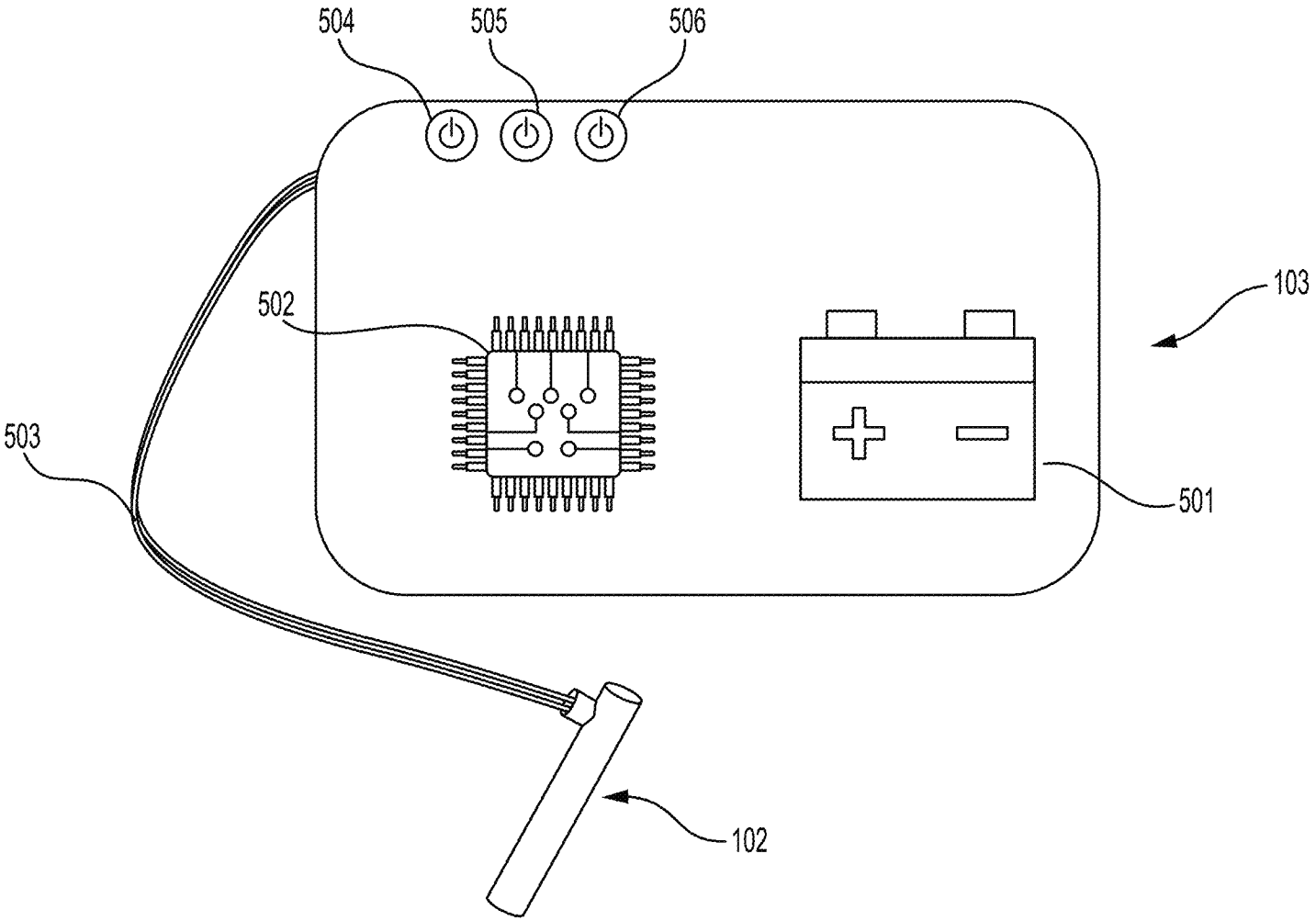
FIG. 5 shows internal components within an external electronic package.

FIG. 5 shows a view of an external electronic package 103 comprising a power supply 501 and circuitry 502 for a laser module 102. In an illustrative embodiment, the laser module 102 is electrically connected to the external electronic package 103 by one or more wires 503. As is known, a laser operating at 50 mW is classified as a class 3B laser, and thus poses a potential eye hazard. To address this risk, several power switches are incorporated into the design to minimize risk posed to the user or nearby observers. The first switch 504 is a master on/off switch for the entire system, the second switch 505 is a momentary switch to detect if the boresight is in bore, and the final switch 506 is a selector switch to choose either high or low output power.

Figure 6B:
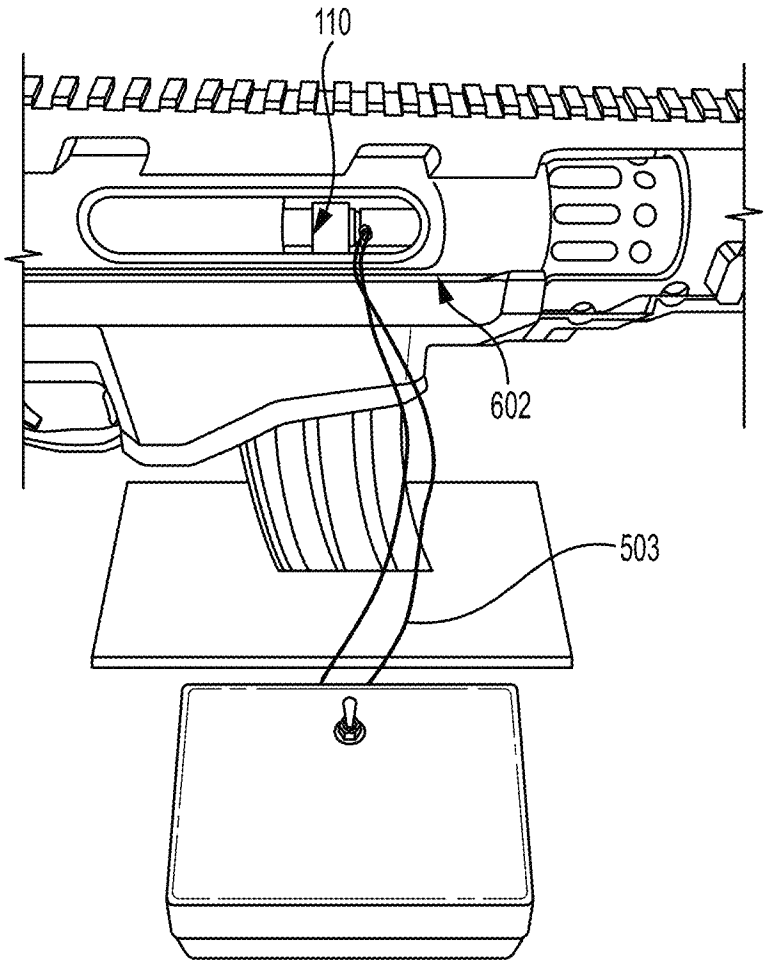
FIG. 6B shows a view of a laser module and hollow cartridge case in a firearm bore.
Figure 6A:
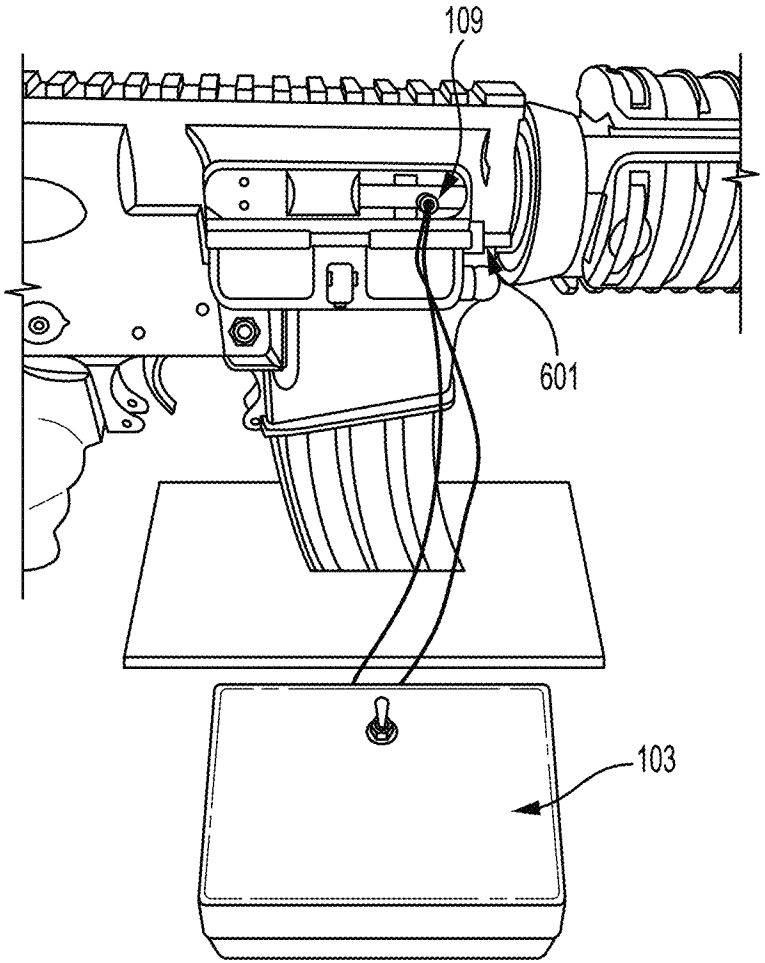
FIG. 6A shows a view of a laser module and a hollow cartridge case in a firearm bore.

FIGS. 6A and 6B show views of hollow cartridge cases 109, 110 in the bore of various firearms. As described above, the hollow cartridge case is sized and shaped to fit within a firearm chamber ranging from 5.56 NATO to .50 BMG. Shown in FIG. 5 as a non-limiting illustrative example is a first case 109 positioned within a 5.56 NATO firearm chamber 601 and a second case 110 positioned within a .300 Win Mag firearm chamber 602. The same laser module 102

(best viewed in FIG. 1), wire 503, and external electronic package 103 can be used with the first and second cases 109, 110. The first hollow cartridge case 109 and laser module 102 can be mated and inserted into the chamber 601 of a first firearm (i.e., 5.56 NATO). After use, the first hollow cartridge case 109 and laser module 102 can removed from the chamber 601 and separated, and the second hollow cartridge case 110 and laser module 102 can be mated and inserted into the chamber 602 of a second firearm (i.e., .300 Win Mag). This can be repeated as many times as desired with various sized cartridge cases.

The in-chamber bore sighting ensures alignment with the barrel of the firearm. In operation, the device is positioned within a firearm chamber, the laser module is activated, which travels through the aperture of the hollow cartridge case and out the barrel. As can be appreciated, the laser provides a visual view of the point of impact of a bullet. The user can then adjust the point of aim of the sighting system (i.e., iron sights, magnified optic, red dot, and the like) so that it corresponds with the point of impact. The laser provides an excellent means for approximating the sighting in of a firearm without the use of ammunition. Once bore sighted, the user can verify and make additional adjustments to refine the alignment with fewer rounds than would otherwise be required without the use of a boresight.

Although the invention has been described in detail with reference to certain preferred embodiments, variations and modifications exist within the spirit and scope of the invention as described and defined in the following claims.

The invention claimed is:

1. An extended range multi-caliber laser boresight system for sighting in a firearm comprising:

a hollow cartridge case comprising an elongated body, an aperture in place of a bullet, an open end, an ejector rim, and a cutout in said body and in said ejector rim;

a laser module comprising a laser diode, focusing optics, and a protrusion; and an external electronic package comprising a power supply, one or more switches, and circuitry for said laser module;

wherein said laser module fits through said open end and is secured within said hollow cartridge case by mating said cutout with said protrusion;

wherein said laser module is electrically connected to said external electronic package through one or more wires; and wherein said laser diode produces a visible laser that exits said hollow cartridge case through said aperture for sighting in said firearm.

2. The laser boresight system of claim 1, wherein said hollow cartridge case is sized and shaped to fit within a firearm chamber ranging from 5.56 NATO to .50 BMG.

3. The laser boresight system of claim 1, wherein said system comprises more than one of said hollow cartridge cases, wherein each of said more than one hollow cartridge cases fits within a different firearm chamber ranging from 5.56 NATO to .50 BMG.

4. The laser boresight system of claim 1, wherein said hollow cartridge case is manufactured to the Sporting Arms and Ammunition Manufacturers' Institute American National Standards.

5. The laser boresight system of claim 1, wherein said external electronic package comprises a master on/off power switch for said laser diode.

6. The laser boresight system of claim 1, wherein said external electronic package comprises a momentary switch for said laser diode to detect if said boresight is in a bore of said firearm.

7. The laser boresight system of claim 1, wherein said external electronic package comprises a high/low output power switch for said laser diode.

8. The laser boresight system of claim 1, wherein said hollow cartridge case is sized and shaped to fit within a 5.56 NATO firearm chamber and wherein said laser diode has a maximum diameter of 9.5 mm.

9. The laser boresight system of claim 1, wherein said laser diode operates in the range of 5 mW-60 mW.

10. The laser boresight system of claim 1, wherein said laser diode comprises a PL520 diode that operates at 50 mW and is visible at distances of greater than 100 yards in sunlit conditions.

11. The laser boresight system of claim 1, wherein said external electronic package comprises a master on/off power switch for said laser diode, a momentary switch for said laser diode to detect if said boresight is in a bore of said firearm, and a high/low output power switch for said laser diode.

12. An extended range multi-caliber laser boresight system for sighting in a firearm comprising: a hollow cartridge case comprising an elongated body, an aperture in place of a bullet, an open end, an ejector rim, and a cutout in said body and in said ejector rim; a laser module comprising a laser diode, focusing optics, and a protrusion; and an external electronic package comprising a power supply, circuitry for said laser module, a master on/off power switch for said laser diode, a momentary switch, and a high/low output power switch; wherein said laser module fits through said open end and is secured within said hollow cartridge case by mating said cutout with said protrusion; wherein said laser module is electrically connected to said external electronic package through one or more wires; and wherein said laser diode produces a visible laser that exits said hollow cartridge case through said aperture for sighting in said firearm.

13. The laser boresight system of claim 12, wherein said hollow cartridge case is sized and shaped to fit within a firearm chamber ranging from 5.56 NATO to .50 BMG.

14. The laser boresight system of claim 12, wherein said system comprises more than one of said hollow cartridge cases, wherein each of said more than one hollow cartridge cases fits within a different firearm chamber ranging from 5.56 NATO to .50 BMG.

15. The laser boresight system of claim 12, wherein said hollow cartridge case is manufactured to the Sporting Arms and Ammunition Manufacturers' Institute American National Standards.

16. The laser boresight system of claim 12, wherein said hollow cartridge case is sized and shaped to fit within a 5.56 NATO firearm chamber and wherein said laser diode has a maximum diameter of 9.5 mm.

17. The laser boresight system of claim 12, wherein said laser diode operates in the range of 5 mW-60 mW.

18. The laser boresight system of claim 12, wherein said laser diode comprises a PL520 diode that operates at 50 mW and is visible at distances of greater than 100 yards in sunlit conditions.

* * * * *